US009409666B1

(12) United States Patent
Staten

(10) Patent No.: US 9,409,666 B1
(45) Date of Patent: Aug. 9, 2016

(54) APPARATUS FOR COLLECTING DEBRIS AND METHOD OF USE

(71) Applicant: Troy Jerel Staten, Loveland, CO (US)

(72) Inventor: Troy Jerel Staten, Loveland, CO (US)

( * ) Notice: Subject to any disclaimer, the term of this patent is extended or adjusted under 35 U.S.C. 154(b) by 197 days.

(21) Appl. No.: 14/244,914

(22) Filed: Apr. 4, 2014

Related U.S. Application Data

(60) Provisional application No. 61/812,730, filed on Apr. 17, 2013.

(51) Int. Cl.
*B65B 67/12* (2006.01)

(52) U.S. Cl.
CPC ..... *B65B 67/1238* (2013.01)

(58) Field of Classification Search
CPC ..... B65B 67/04; B65B 67/12; B65B 37/1238
USPC ..... 141/10, 114, 313, 314, 316, 391
See application file for complete search history.

(56) References Cited

U.S. PATENT DOCUMENTS 5,011,103 A * 4/1991 Hayes ..... B65B 67/1255 248/95
5,031,277 A 7/1991 Coker
5,393,022 A * 2/1995 Palumbo ..... B65B 69/00 248/95
5,593,117 A * 1/1997 Alexander, III ..... B65B 67/04 248/95
7,490,787 B1 * 2/2009 Salazar ..... A01G 1/125 241/285.2
7,815,153 B2 * 10/2010 Campbell ..... B65B 67/04 248/95
8,047,477 B2 * 11/2011 Wilkinson ..... B65B 67/1238 248/94
8,882,350 B2 * 11/2014 Cheney ..... B65F 1/1415 248/99
2005/0011997 A1 * 1/2005 Kalal ..... B65B 67/04 248/99
2007/0095419 A1 * 5/2007 Campbell ..... B65B 67/04 141/10
2010/0200709 A1 * 8/2010 Wilkinson ..... B65B 67/1238 248/99
2011/0041954 A1 * 2/2011 Noonan ..... A01G 1/125 141/316
2012/0248118 A1 * 10/2012 Perkowski ..... B65B 67/1205 220/495.08

* cited by examiner

*Primary Examiner* — Nicolas A Arnett
(74) *Attorney, Agent, or Firm* — Ted Masters

(57) ABSTRACT

Apparatus for collecting debris which resides upon a support surface includes a body which has an open mouth end and an opposite closed end. Two diverters are connected to opposite sides of the open end. The diverters are angularly positioned so that they channel the debris into the open end of the apparatus. In one embodiment the apparatus is held in place by staking the distal ends of the diverters to the support surface such as a lawn. In another embodiment weights are placed in pockets in the diverters to hold the apparatus in place on a hard surface such as a driveway.

18 Claims, 8 Drawing Sheets

20
26
22
32
24
28
34
38
40
500
30
600
36
42
44

20
26
22
24
32
28
34
38
40
500
30
600
36
42
44

20
10
34
52
700
40
48
54
600
56
44

20
48
50
52
52
700
702

APPARATUS FOR COLLECTING DEBRIS AND METHOD OF USE

CROSS REFERENCE TO RELATED APPLICATION

This application claims the filing benefit under 35 U.S.C. §119(e) of U.S. Provisional Application No. 61/812,730, filed Apr. 17, 2013, which is hereby incorporated by reference.

TECHNICAL FIELD

The present invention pertains generally to debris collection, and more particularly to apparatus and method for effecting the collection.

BACKGROUND OF THE INVENTION

Yard debris collection presents a problem for the occupants of residential property. In the fall leaves must be collected, and at other times of the year grass clippings must be removed. Blowers and rakes can be used to move the debris into piles, however in order to be transported, the debris must be packaged within a bag or other collection device.

BRIEF SUMMARY OF THE INVENTION

The present invention is directed to apparatus and method for collecting debris. The apparatus and method are particularly useful in collecting yard debris such as leaves, grass clippings, twigs and branches, and the like, but can also be used to collect other types of residential or commercial debris. The user fills the apparatus with the debris, and can then transport the debris-filled apparatus to a disposal area or facility. The apparatus is positioned on a support surface and the debris is blown or otherwise directed into the apparatus. The apparatus has two diverters which are positioned so that they channel the debris into the mouth of the apparatus. The apparatus can be used on soft support surfaces such as a lawn or the ground, wherein stakes are used to hold the apparatus in place. Or, the apparatus can be used on a hard support surface such as concrete or asphalt wherein weights are used to hold the apparatus in place.

In accordance with an embodiment, apparatus for collecting debris is positionable upon a support surface. The apparatus includes a body which has a first end and an opposite second end. The first end has a first side, an opposite second side, and a mouth for receiving the debris. A first diverter is connected to the first side of the first end, and a second diverter connected to the second side of the first end. The first and second diverters are positionable so that they channel the debris into the mouth. The first diverter has a first distal end. A first stake is provided for connecting the first distal end to the support surface. The second diverter has a second distil end. A second stake is provided for connecting the second distal end to the support surface.

In accordance with another embodiment, the first end includes a first wire frame which forms the mouth.

In accordance with another embodiment, the second end includes a second wire frame.

In accordance with another embodiment, the apparatus cooperates with first and second weights. The first diverter includes a first pocket for receiving the first weight, and the second diverter includes a second pocket for receiving the second weight.

In accordance with another embodiment, the apparatus cooperates with a tether. The body includes a tether connector for attaching the tether.

In accordance with another embodiment, the body and the first and second diverters are made from fabric.

In accordance with another embodiment, the first stake is connected to the first distal end of the first diverter, and the second stake is connected to the second distal end of the second diverter.

In accordance with another embodiment, the first and second diverters are positionable to cover the mouth.

In accordance with another embodiment, the first and second diverters each have a triangular shape.

Other embodiments, in addition to the embodiments enumerated above, will become apparent from the following detailed description, taken in conjunction with the accompanying drawings, which illustrate, by way of example, the principles of the apparatus and method of use.

DETAILED DESCRIPTION OF THE INVENTION

Figure 1:
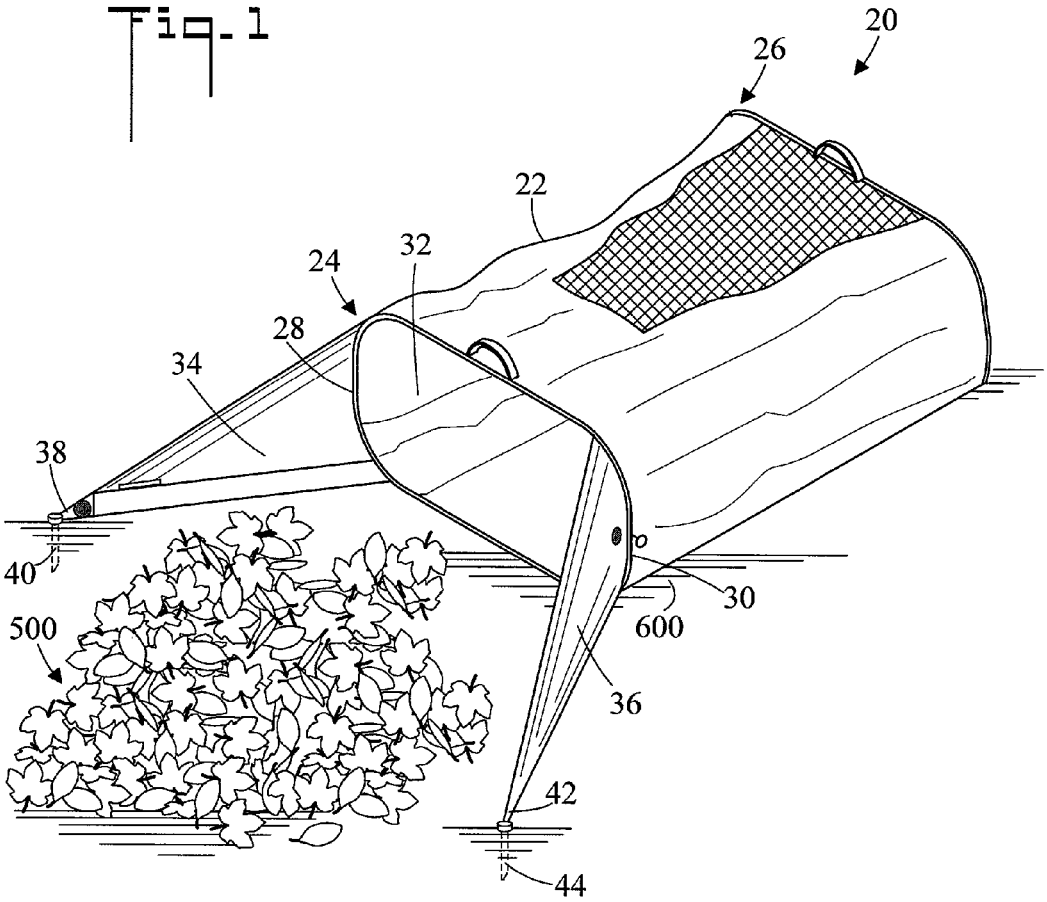
FIG. 1 is a perspective view of apparatus for collecting debris.
Figure 2:
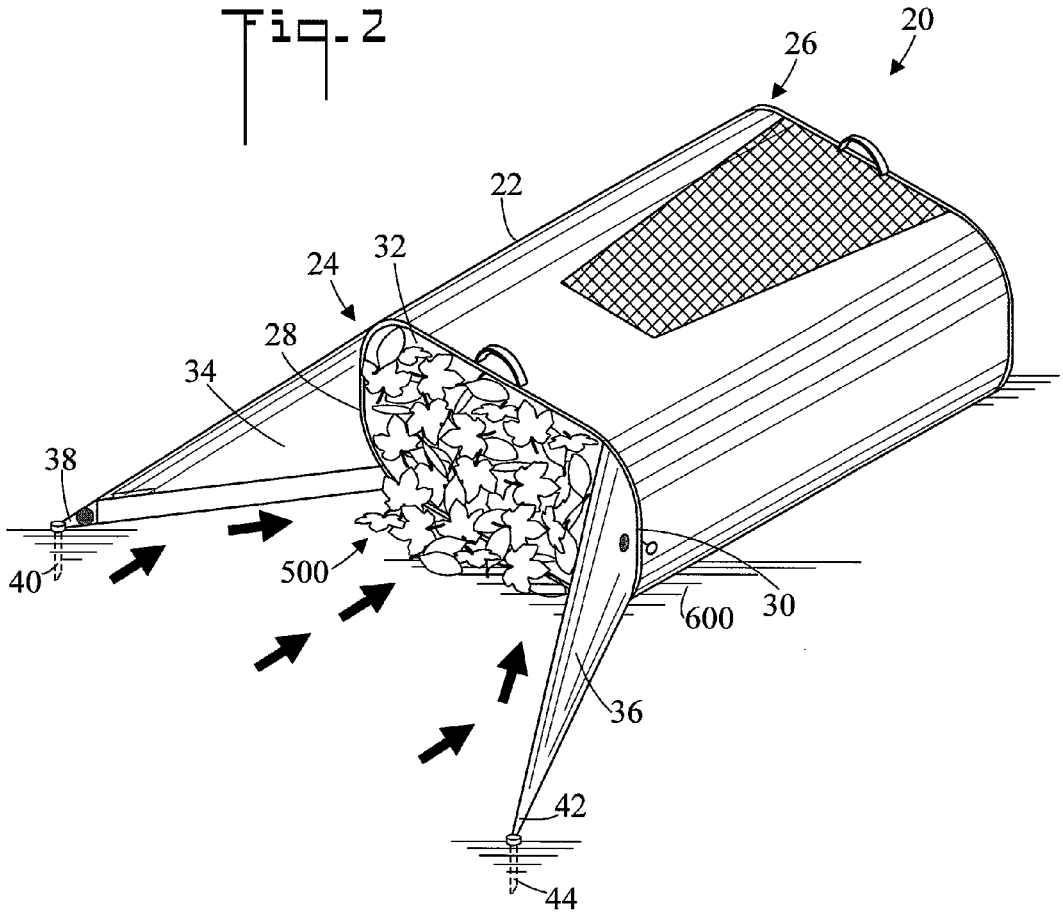
FIG. 2 is a perspective view of the apparatus filled with debris.
Figure 3:
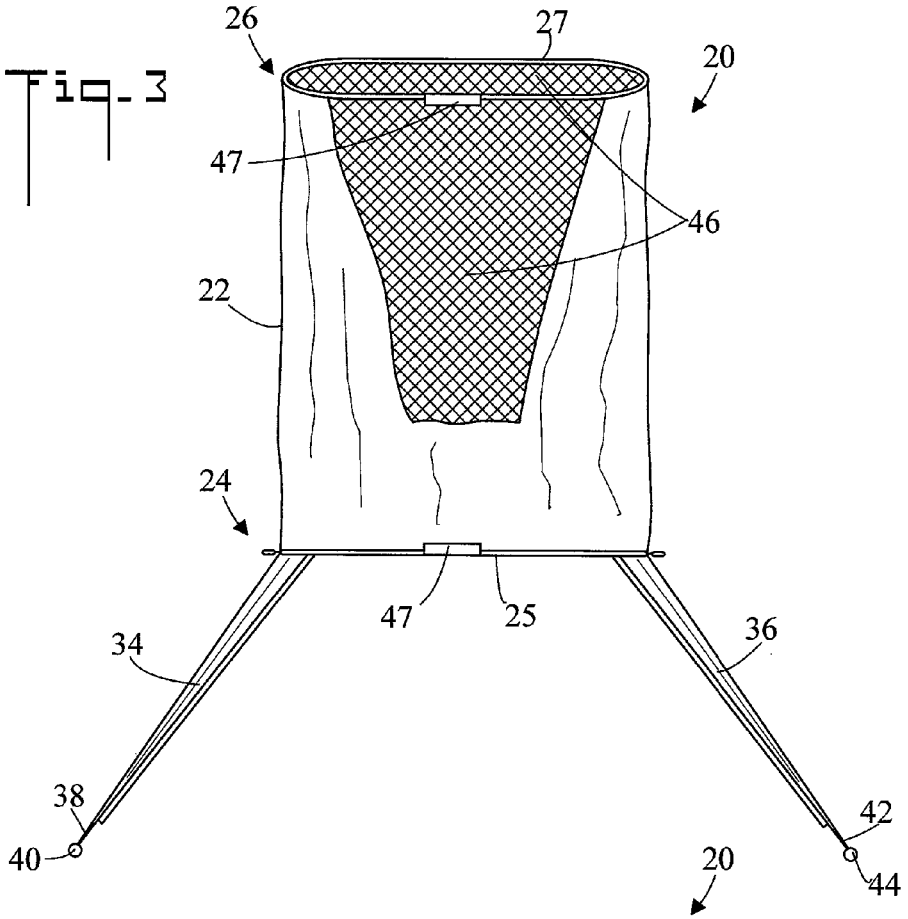
FIG. 3 is top plan view of the apparatus.
Figure 4:
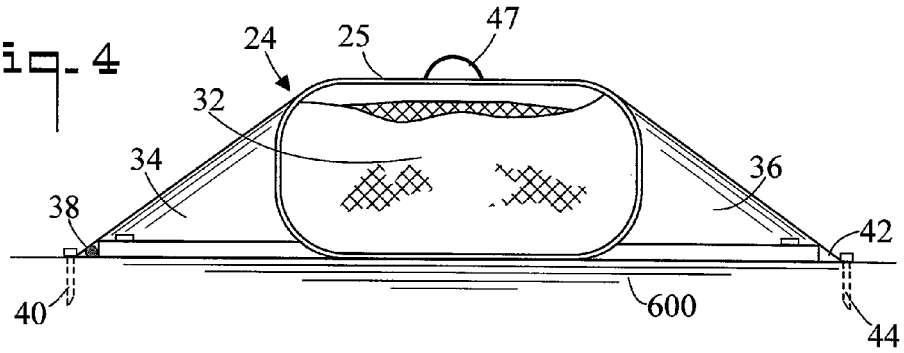
FIG. 4 is a front elevation view of the apparatus.
Figure 5:
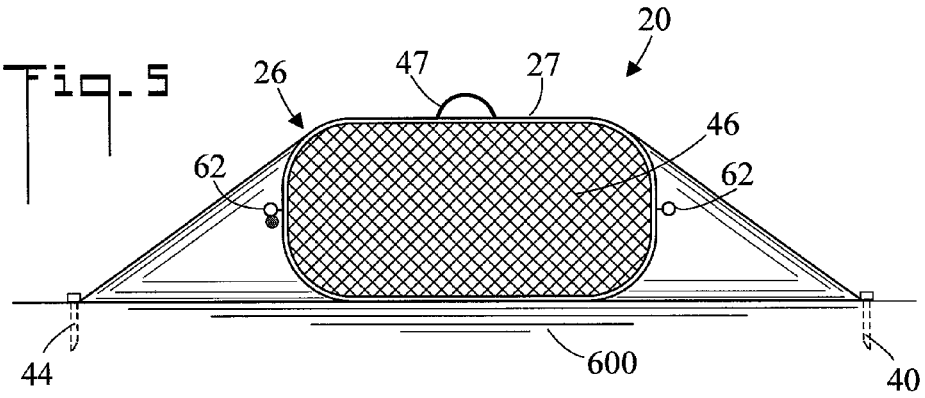
FIG. 5 is a rear elevation view of the apparatus.
Figure 6:
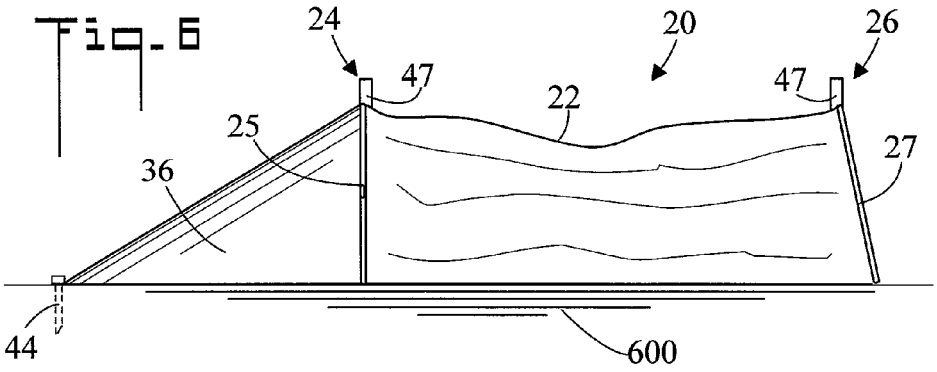
FIG. 6 is a side elevation view of the apparatus.

Referring initially to FIGS. 1 and 2, there are illustrated empty and filled views respectively of apparatus 20 for collecting debris 500, apparatus 20 being positionable upon a support surface 600. In the shown embodiment support surface 600 is a soft surface such as a lawn or the ground upon which debris 600 is disposed. However in another embodiment of apparatus 20, support surface 600 can be a hard surface such as a concrete or asphalt driveway, a stone or brick walkway, a road, or the like (refer to FIGS. 8-11 and the associated discussions). Apparatus 20 includes a body 22 which has a first end 24 and an opposite second end 26. First end 24 has a first side 28, an opposite second side 30, and a mouth 32 for receiving debris 500. A first diverter 34 is connected to first side 28 of first end 24, and a second diverter 36 is connected to second side 30 of first end 24. First 34 and second 36 diverters are positionable so that they channel debris 500 into mouth 32. That is, first 34 and second 36 diverters are angled with respect to the longitudinal center line of body 22, so that they serve to funnel debris 500 into open mouth 32. First diverter 34 has a first distal end 38. A first stake 40 is provided for connecting first distal end 38 to support surface 600. Second diverter 36 has a second distal end 42. A second stake 44 is provided for connecting second distal end 42 to support surface 600. That is, stakes 40 and 44 are driven into support surface 600 (e.g. a lawn or the ground) to anchor apparatus 20 in place.

In FIG. 1, apparatus 20 is shown empty and ready to receive debris 500, such as the shown leaves. In FIG. 2, apparatus 20 is filled wherein debris 500 has been moved toward apparatus 20 in the direction of the arrows, such as by using a blower, rake, or even by the wind. As debris 500 is moved toward apparatus 20, diverters 34 and 36 deflect the debris and channel it into mouth 32. It is also noted that in FIG. 2 debris 500 causes body 22 to expand with respect to the unfilled configuration of FIG. 1.

Figure 7:
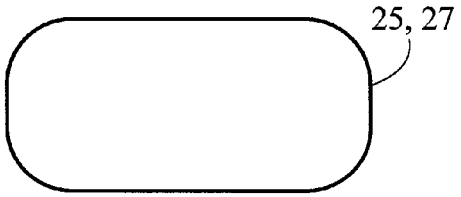
FIG. 7 is a front elevation view of a wire frame.

Now referring to FIGS. 3-6, there are shown top plan, front elevation, rear elevation, and side elevation views respectively of apparatus 20. FIG. 7 shows a front elevation view of two wire frames 25 and 27 (each being the same in the shown embodiment). Wire frames 25 and 27 are each a closed contour (i.e. they are each a continuous loop which does not have ends). Body 22 has a top and an opposite bottom which resides on support surface 600. First end 24 includes a first wire frame 25 (such as made of resilient spring wire) which forms mouth 32. Second end 26 includes a second wire frame 27 which shapes second end 26. Wire frames 25 and 27 hold first end 24 and second end 26 in a generally rounded rectangular shape (a rectangle with rounded corners).

In an embodiment, body 22, first diverter 34 and second diverter 36 are each made from a flexible fabric (synthetic or natural). In an embodiment, the fabric is somewhat stiff so that, in conjunction with frames 25 and 27 and stakes 40 and 44, apparatus 20 will retain the shape depicted in FIG. 1 when empty, with mouth 32 positioned to receive debris 500. A fabric such as a polymer tarp could be utilized. The fabric can also be waterproof and biodegradable. Because body 22, first diverter 34 and second diverter 36 are made from fabric, apparatus 20 is collapsible, and can be folded and stored in a carrying bag. It is noted that in the shown embodiment first diverter 34 and second diverter 36 are made from unsupported (no ribs or other support members) fabric, and also first 34 and second 36 diverters have a triangular shape. It is noted that the triangular shape of first diverter 34 is formed by distal end 38 of first diverter 34 and two points on first side 28 of first end 24 of body 22, and the triangular shape of second diverter 36 is formed by second distal end 42 of second diverter 36 and two points on second side 30 of first end 24 of body 22.

Body 22 and second end 26 are closed so as to retain debris 500. Second end 26 and a portion of the top of body 22 are make from breathable netting material 46 which will pass air therefore allowing body 22 to fill with debris 500, but which will not pass debris 500.

In the shown embodiment, first stake 40 is directly and permanently connected to first distal end 38 of first diverter 34, and second stake 44 is directly and permanently connected to second distal end 40 of second diverter 36. As such, stakes 40 and 44 are always readily available to anchor apparatus 20 to support surface 600. However, in another embodiment, stakes 40 and 44 are not connected to the diverters (refer to FIG. 13). Two carrying handles 47 are provided for transporting apparatus 20.

Figure 8:
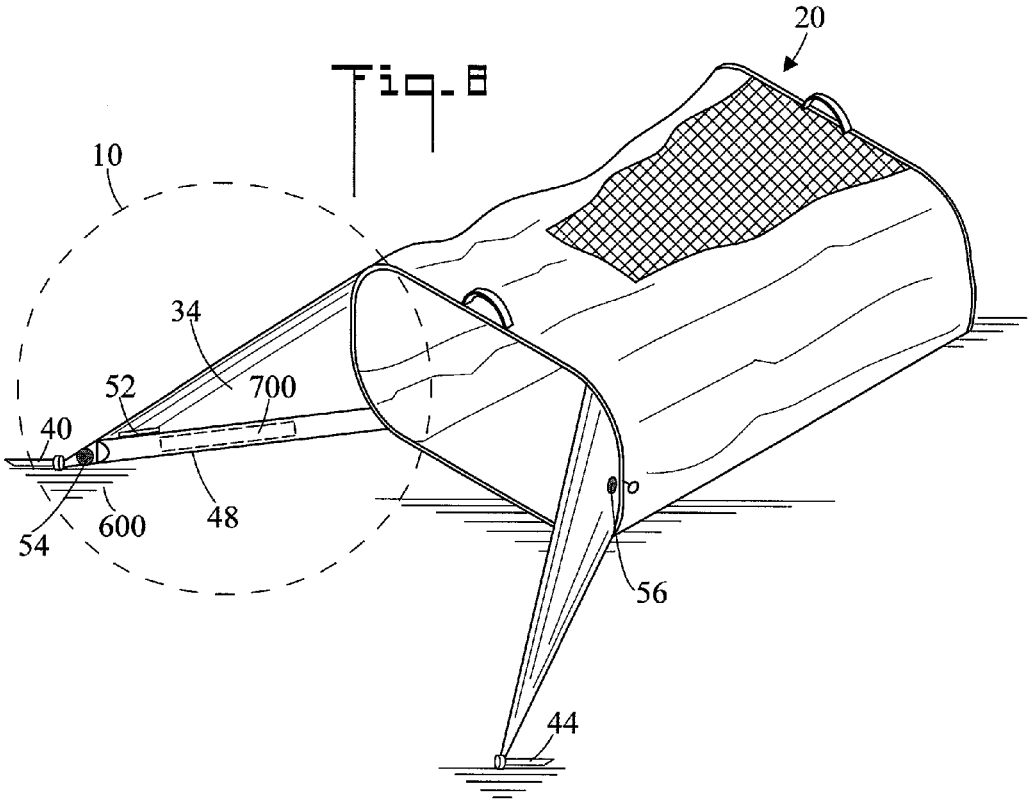
FIG. 8 is a perspective view of a second embodiment of the apparatus.
Figure 9:
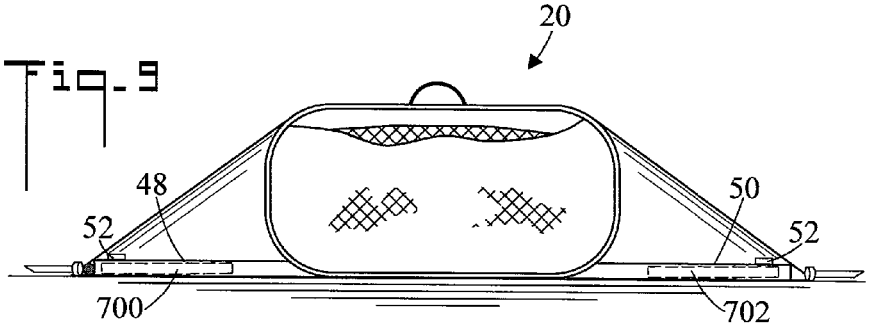
FIG. 9 is a front elevation view of the second embodiment.
Figure 10:
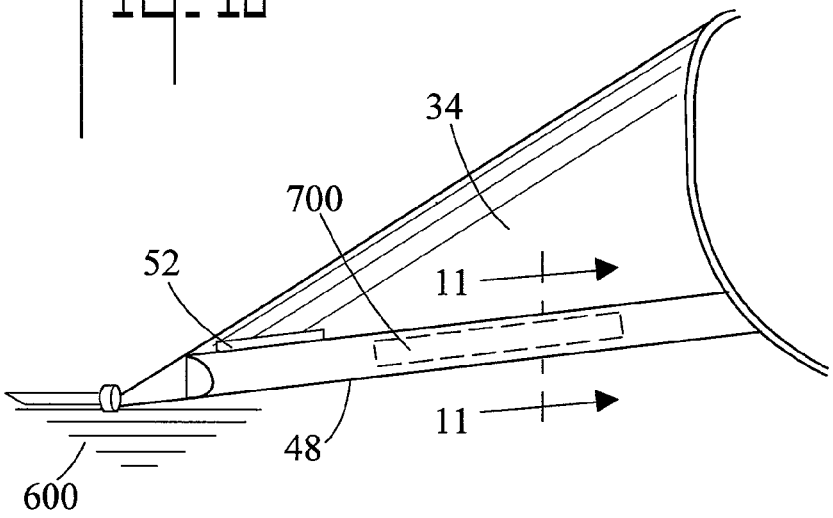
FIG. 10 is an enlarged view of area 10 of FIG. 8.
Figure 11:
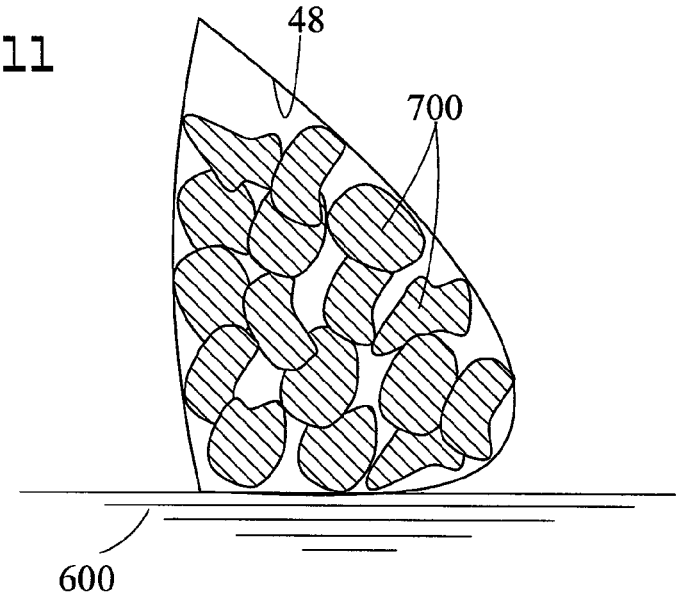
FIG. 11 is an enlarged cross sectional view along the line 11-11 of FIG. 10.

FIGS. 8 and 9 are perspective and front elevation view respectively of a second embodiment of apparatus 20. FIG. 10 is an enlarged view of area 10 of FIG. 8, and FIG. 11 is an enlarged cross sectional view along the line 11-11 of FIG. 10. In this embodiment, apparatus 20 is held in place upon support surface 600, not by stakes 40 and 44, but rather by first 700 and second 702 weights. Weights 700 and 702 can be sand, rocks (shown), pieces of metal, or any other weight which will hold apparatus 20 in place on a support surface 600 which is too hard to accept stakes 40 and 44 (e.g. a concrete driveway). First diverter 34 includes a first pocket 48 for receiving first weight 700, and second diverter 36 includes a second pocket 50 for receiving second weight 702. Pockets 48 and 50 are located on the lower part of first diverter 34 and second diverter 36 respectively so that they are adjacent support surface 600 when apparatus 20 is placed thereon. Weights 700 and 702 are removably received by first 48 and second 50 pockets respectively. A closure 52 such as of hook and loop fasteners allows pockets 48 and 50 to be selectively opened to receive weights 700 and 702 respectively, and then closed. It is noted that in FIG. 8 first stake 40 and second stake 44 are not utilized to connect apparatus 20 to support surface 600, but rather simply lay on support surface 600.

Figure 12:
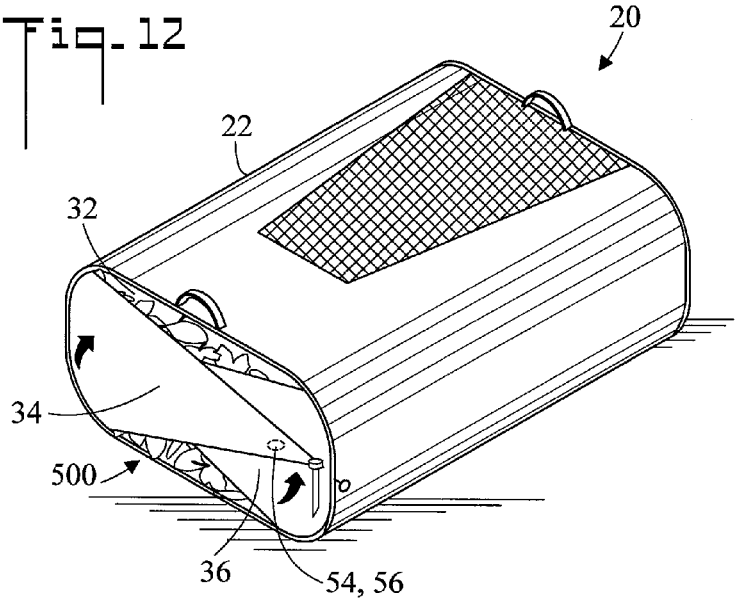
FIG. 12 is a perspective view of the apparatus with first and second diverters positioned to cover the mouth of the apparatus.

FIG. 12 is a perspective view of apparatus 20 with first 34 and second 36 diverters positioned to cover 32 mouth of apparatus 20. Referring also to FIG. 8, the inside distal end of first diverter 34 includes a first half connector 54 (e.g. of a hook and loop fastener), and the outside proximal end of second diverter 36 includes a second half connector 56 (e.g. of a mating hook and loop fastener). Once apparatus 20 is filled with debris 500, first diverter 34 is overlapped with and connected to second diverter 36 using first 54 and second 56 half connectors. As such, first 34 and second 36 diverters retain debris 500 within body 22 for transportation or storage purposes.

Figure 13:
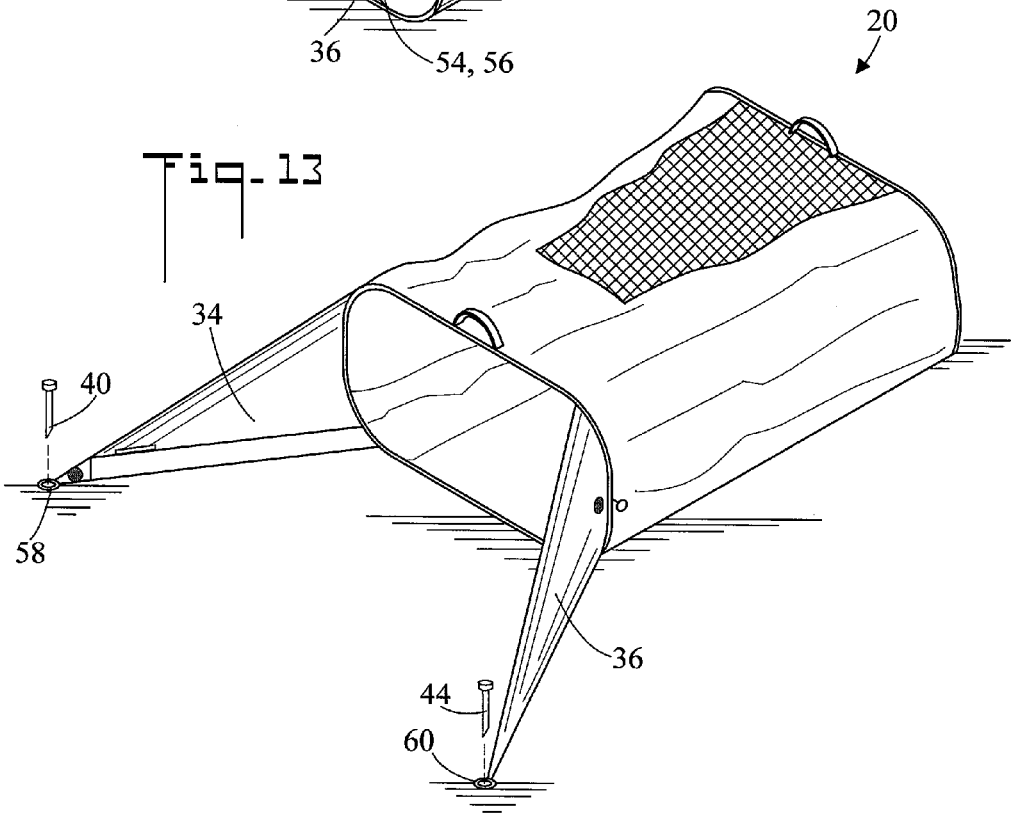
FIG. 13 is a perspective view of a third embodiment of the apparatus.

FIG. 13 is a perspective view of a third embodiment of apparatus 20. In this embodiment stakes 40 and 44 are not permanently connected to the distal ends of diverters 34 and 36 respectively as in the previously described embodiment. Rather, stakes 40 and 44 are separately provided. First diverter 34 has a first stake-receiving grommet 58, and second diverter 36 has a second stake-receiving grommet 60.

Figure 14:
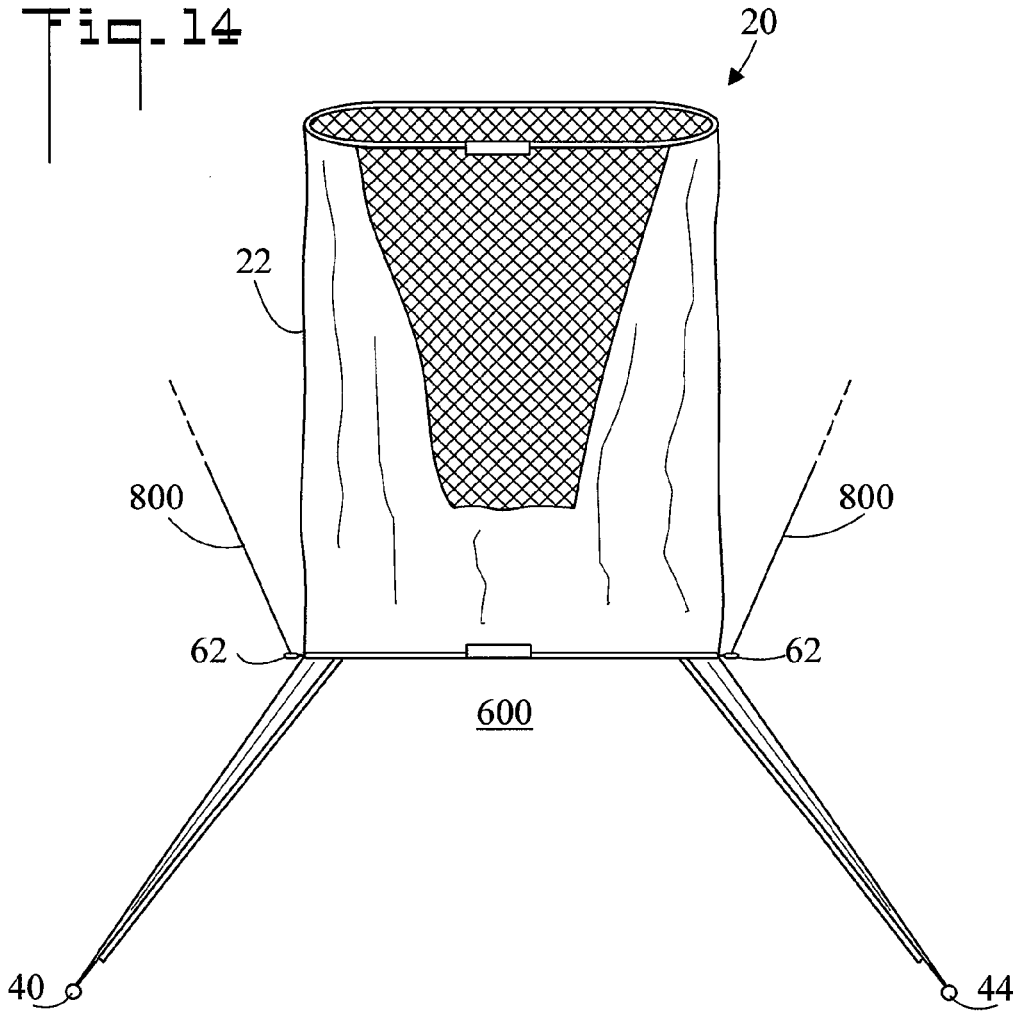
FIG. 14 is a perspective view tethers being used to hold the apparatus.

FIG. 14 is a perspective view of tethers 800 being used to hold apparatus 20 in place on support surface 600. Body 22 includes a tether connector 62 (two in the shown embodiment) for attaching tethers 800. In the shown embodiment, tether connectors 62 are rings. Tethers 800 are lines which connect tether connectors 62 to a stationary object so that tethers 800 generally extend away from first stake 40 and second stake 44, and therefore serve to hold apparatus 20 in place such as in windy conditions.

In terms of use, a method for collecting debris 500 includes: (refer to FIGS. 1-14)

(a) providing a support surface 600;

(b) providing debris 500 to be collected, the debris 500 disposed upon the support surface 600;

(c) providing apparatus 20 for collecting the debris 500, the apparatus 20 including;

- a body 22 having a first end 24 and an opposite second end 24;
- the first end 24 having a first side 28, an opposite second side 30, and a mouth 32 for receiving the debris 500;
- a first diverter 34 is connected to first side 28 of the first end 24, and a second diverter 36 is connected to the second side 30 of the first end 24;
- the first diverter 34 having a first distal end 38;
- a first stake 40 for connecting the first distal end 38 to the support surface 600;
- the second diverter 36 having a second distal end 42;
- a second stake 44 for connecting the second distal end 42 to the support surface 600;

(d) placing the apparatus 20 on the support surface 600;

(e) using the first stake 40 to connect the first distal end 38 of the first diverter 34 to the support surface 600;

(f) using the second stake 44 to connect the second distal end 42 of the second diverter 36 to the support surface 600;

in (e) and (f), the connecting including positioning the first 34 and second 36 diverters so that they channel the debris 500 into the mouth 32; and, (g) moving the debris 500 into the mouth 32.

The method further including:

after (g), using the first 34 and second 36 diverters to cover the mouth 32.

Another method for collecting debris 500 includes: (refer to FIGS. 1-14)

(a) providing a support surface 600;

(b) providing debris 500 to be collected, the debris 500 disposed upon the support surface 600;

(c) providing a first weight 700 and a second weight 702;

(d) providing apparatus 20 for collecting the debris 500, the apparatus 20 including;

a body 22 having a first end 24 and an opposite second end 26;

the first end 24 having a first side 28, an opposite second side 30, and a mouth 32 for receiving the debris 500;

a first diverter 34 is connected to the first side 28 of the first end 24, and a second diverter 36 connected to the second side 30 of the first end 24;

the first diverter 34 including a first pocket 48 for receiving the first weight 700, and the second diverter 36 including a second pocket 50 for receiving the second weight 702;

(e) placing the apparatus 20 on the support surface 600;

(f) placing the first weight 700 in the first pocket 48 of the first diverter 34, and placing the second weight 702 in the second pocket 50 of the second diverter 36;

(g) positioning the first 34 and second 36 diverters so that they channel the debris 500 into the mouth 32; and, (h) moving the debris 500 into the mouth 32.

The embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

I claim:

1. Apparatus for collecting debris, the apparatus positionable upon a support surface, the apparatus comprising:

a body having a first end and an opposite second end;

said first end having a first side, an opposite second side, and a mouth for receiving the debris;

said first end including a first wire frame which forms said mouth, said first wire frame being a closed contour;

a first diverter connected to said first side of said first end, and a second diverter connected to said second side of said first end;

said first and second diverters positionable so that they channel the debris into said mouth;

said first diverter having a first distal end;

a first stake for connecting said first distal end to the support surface;

said second diverter having a second distal end; and, a second stake for connecting said second distal end to the support surface.

2. The apparatus according to claim 1, further including:

said first wire frame having a rounded rectangular shape.

3. The apparatus according to claim 1, the apparatus cooperating with first and second weights, the apparatus further including:

said first diverter including a first pocket for receiving the first weight; and, said second diverter including a second pocket for receiving the second weight.

4. The apparatus according to claim 1, further including:

a tether; and, said body including a tether connector for attaching said tether, so that said tether generally extends away from said first stake.

5. The apparatus according to claim 1, further including:

said body being made from fabric;

said body including a top;

said second side and a portion of said top each including a netting material which will pass air but not the debris; and, said first and second diverters each being made from fabric.

6. The apparatus according to claim 1, further including:

said first stake directly and permanently connected to said first distal end of said first diverter; and, said second stake directly and permanently connected to said second distal end of said second diverter.

7. The apparatus according to claim 1, further including:

said first and second diverters being positionable to cover said mouth, wherein said first diverter is overlapped with said second diverter.

8. The apparatus according to claim 7, further including:

said first diverter including a first half connector, and said second diverter including a second half connector; and, said first diverter connected to said second diverter by said first half connector said second half connector.

9. The apparatus according to claim 1, further including:

said first and second diverters each being made from unsupported fabric; and, said first and second diverters each having a triangular shape, wherein said triangular shape of said first diverter is formed by said first distal end of said first diverter and two points on said first side of said first end of said body, and said triangular shape of said second diverter is formed by said second distal end of said second diverter and two points on said second side of said first end of said body.

10. Apparatus for collecting debris, the apparatus positionable upon a support surface, the apparatus comprising:

a body having a first end and an opposite second end;

said first end having a first side, an opposite second side, and a mouth for receiving the debris;

a first diverter connected to said first side of said first end, and a second diverter connected to said second side of said first end;

said first and second diverters positionable so that they channel the debris into said mouth;

said first end including a first wire frame which forms said mouth, said first wire frame being a closed contour;

said second end including a second wire frame;

said body being made from fabric; and, said first and second diverters each being made from fabric.

11. The apparatus according to claim 10, the apparatus cooperating with first and second weights, the apparatus further including:

said first diverter including a first pocket for receiving the first weight; and, said second diverter including a second pocket for receiving the second weight.

12. The apparatus according to claim 10, further including:
said first diverter having a first distal end;
a first stake for connecting said first distal end to the support surface;
a tether; and,
said body including a tether connector for attaching said tether, so that said tether generally extends away from said first stake.

13. The apparatus according to claim 10, further including:
said first diverter having a first distal end;
a first stake for connecting said first distal end to the support surface;
said second diverter having a second distal end;
a second stake for connecting said second distal end to the support surface;
said first stake directly and permanently connected to said first distal end of said first diverter; and,
said second stake directly and permanently connected to said second distal end of said second diverter.

14. The apparatus according to claim 10, further including:
said first and second diverters being positionable to cover said mouth, wherein said first diverter is overlapped with said second diverter.

15. The apparatus according to claim 14, further including:
said first diverter including a first half connector, and said second diverter including a second half connector; and,
said first diverter connected to said second diverter by said first half connector said second half connector.

16. The apparatus according to claim 10, further including:
said first and second diverters each being made from unsupported fabric; and,
said first and second diverters each having a triangular shape, wherein said triangular shape of said first diverter is formed by said first distal end of said first diverter and two points on said first side of said first end of said body, and said triangular shape of said second diverter is formed by said second distal end of said second diverter and two points on said second side of said first end of said body.

17. A method for collecting debris, comprising:
(a) providing a support surface;
(b) providing debris to be collected, said debris disposed upon said support surface;
(c) providing apparatus for collecting said debris, said apparatus including;
a body having a first end and an opposite second end;
said first end having a first side, an opposite second side, and a mouth for receiving said debris;
said first end including a first wire frame which forms said mouth, said first wire frame being a closed contour;
a first diverter connected to said first side of said first end, and a second diverter connected to said second side of said first end;
said first diverter having a first distal end;
a first stake for connecting said first distal end to said support surface;
said second diverter having a second distal end;
a second stake for connecting said second distal end to said support surface;
(d) placing said apparatus on said support surface;
(e) using said first stake to connect said first distal end of said first diverter to said support surface;
(f) using said second stake to connect said second distal end of said second diverter to said support surface;
in (e) and (f), said connecting including positioning said first and second diverters so that they channel said debris into said mouth; and,
(g) moving said debris into said mouth.

18. The method of claim 17, further including:
after (g), using said first and second diverters to cover said mouth, wherein said first diverter is overlapped with said second diverter.

* * * * *